US007963421B2

(12) United States Patent
Zeiler et al.

(10) Patent No.: US 7,963,421 B2
(45) Date of Patent: Jun. 21, 2011

(54) HINGED LID FOR A FOOD CONTAINER

(75) Inventors: George Zeiler, Olathe, KS (US); Gregory L. Webb, Wilmington, OH (US)

(73) Assignee: Huhtamaki, Inc., Desoto, KS (US)

( * ) Notice: Subject to any disclaimer, the term of this patent is extended or adjusted under 35 U.S.C. 154(b) by 0 days.

(21) Appl. No.: 12/835,073

(22) Filed: Jul. 13, 2010

(65) Prior Publication Data

US 2010/0270323 A1 Oct. 28, 2010

Related U.S. Application Data

(62) Division of application No. 11/833,752, filed on Aug. 3, 2007, now Pat. No. 7,775,395.

(51) Int. Cl.
*B65D 51/04* (2006.01)
*B65D 43/14* (2006.01)

(52) U.S. Cl. ..... 220/836; 220/833

(58) Field of Classification Search ..... 220/254.1, 220/254.3, 254.4, 268, 810, 831, 833, 836, 220/867, 837

See application file for complete search history.

(56) References Cited

U.S. PATENT DOCUMENTS

| | | | | |
|---|---|---|---|---|
| 2,541,604 | A | 2/1951 | Normandin | |
| 3,417,897 | A | 12/1968 | Johnson | |
| 4,375,711 | A | 3/1983 | Franzen et al. | |
| 4,634,019 | A * | 1/1987 | Pherigo | 220/810 |
| 5,145,088 | A | 9/1992 | Goujon | |
| 6,003,203 | A | 12/1999 | Fowlston | |
| 6,523,713 | B1 | 2/2003 | Helms | |
| 6,772,904 | B1 | 8/2004 | Gilliam et al. | |
| 7,097,446 | B2 | 8/2006 | Crider | |
| 7,775,395 | B2 * | 8/2010 | Zeiler et al. | 220/836 |
| 2007/0062949 | A1 | 3/2007 | Bordner | |

FOREIGN PATENT DOCUMENTS

| | | |
|---|---|---|
| CH | 471007 | 4/1969 |
| GB | 2382569 A | 6/2003 |
| WO | 0144058 A2 | 6/2001 |

* cited by examiner

*Primary Examiner* — Anthony Stashick
*Assistant Examiner* — Harry A Grosso
(74) *Attorney, Agent, or Firm* — Husch Blackwell LLP

(57) ABSTRACT

A hinged lid for a food container is provided. The lid structure includes a rim with an attached cover member. The lid structure also includes a mounting structure for mounting the lid structure to a food container. A tamper evidence latch is provided to releasably secure the rim in a closed configuration overlying the open end of the food container. The rim engages an upper rolled lip of the food container sidewall when the lid structure is in a closed configuration.

1 Claim, 5 Drawing Sheets

HINGED LID FOR A FOOD CONTAINER

CROSS-REFERENCE TO RELATED APPLICATIONS

This Application is a Divisional of and claims priority to U.S. application Ser. No. 11/833,752 filed Aug. 3, 2007 now U.S. Pat. No. 7,775,395 to George Zeiler and Gregory L. Webb entitled "Hinged Lid for a Food Container," currently pending, which document is hereby incorporated by reference to the extent permitted by law.

BACKGROUND OF INVENTION

Containers for food products are well known in the art. Such containers typically include a receptacle and a lid. The lid may be attached to the container in various manners, for example, a friction fit, a screw connection, a permanently attached lid, an adhesively attached lid and the like. Examples of such containers may be found in U.S. Pat. Nos. 6,772,904, 3,417,897, 5,145,088, 7,097,446 and 2,541,604. Each of the just mentioned patents disclose a container construction having a hinged lid or a hinged lid portion.

In the manufacture of some food containers, the receptacle may be made from paper stock having a seamed sidewall, a bottom connected to the sidewall via a formed seam and an upper portion forming the open end of the container and having an upper rolled lip. The lip provides some resistance to bending of the upper portion of the container during use and part of the closing means for the associated lid. The paper is oftentimes coated to prevent the migration of liquid such as fat and water into the paper material substrate. Some lid constructions may be provided to further enhance the strength of the receptacle open end as it relates to bending thereof. As disclosed in some of the above mentioned patents, the cover portion of the lid may be hingedly connected to the receptacle. Further, the cover may be constructed to provide for releasable engagement between the cover and the receptacle to secure the cover in a closed configuration.

In the manufacture of food containers, cost and functionality are the two primary considerations in their design. Typically, packaging margins are low and even small decreases in cost are highly desirable. Additionally, any increase in functionality without an increase in cost or even a reduction in cost, is also highly desirable.

It would be desirable to have a lid structure configured for attachment to a receptacle where the lid structure provides tamper evidence, ease of assembly and a hinged connection between the moveable cover portion of the lid structure and the receptacle. It is further highly desirable to have a plastic lid structure operably mounted on a paper board container.

SUMMARY OF INVENTION

The present invention involves the provision of a lid structure configured for attachment to a receptacle having a sidewall with an open end portion defining an access thereto. The receptacle sidewall may also be provided with a rolled upper lip portion. The lid structure has a rim with a portion positioned on the outside of the upper end portion of the receptacle sidewall and circumscribing at least a substantial portion thereof. The lid structure has a flange overlying the open end of the container receptacle and is affixed thereto via a mount structure. In one embodiment, a living hinge member extends between the mount structure and the rim permitting hinged movement of the rim relative to the receptacle. A cover is fixed to the rim to be in overlying relationship to the access opening when the cover is in a closed configuration. A latch member is mounted to the rim and is operable to move relative to the rim and selectively lock the cover in a lid structure closed position by engaging a portion of the upper lip. The rim has portions extending to opposite edges of the latch member. The rim circumscribes and engages a portion of the sidewall.

BRIEF DESCRIPTION OF DRAWINGS

Like numbers throughout the various figures designate like or similar parts or structure.

DETAILED DESCRIPTION

Figure 1:
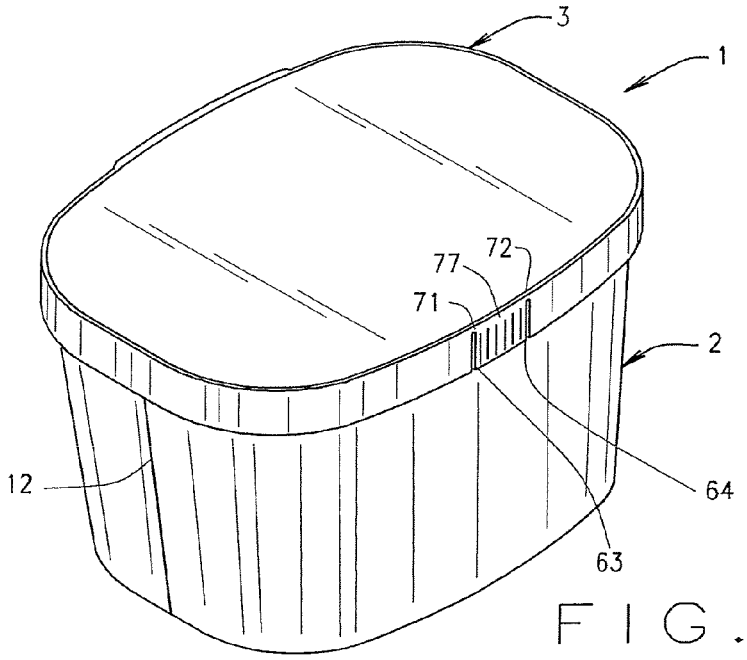
FIG. 1 is a perspective view of a food container showing the lid structure in a closed configuration in accordance with one embodiment of the present invention.

The reference 1 designates generally a container (generally used for food products) comprising a receptacle 2 and a lid structure 3. In the illustrated structure, the receptacle 2 includes a sidewall 4 and a bottom wall 5. Receptacle 2 has an upper open end 6 that provides an access opening thereto. The upper portion of the receptacle 2 has an outwardly rolled upper lip 8 as best seen in FIG. 3.

In a preferred embodiment, the receptacle 2 is formed from paperboard which can be farmed by wrapping the paper board about a mandrel and joining the edge margin portions of the blank forming the sidewall 4 seam 12. The receptacle 2 includes the bottom wall 5 which may be secured to the sidewall 4 as by heat bonding or via use of a adhesives. Such receptacles are well known in the industry. It is preferred, that when paperboard is used, that the paperboard be coated to prevent the migration of components of food, for example, water and/or fat into the paper. The coating can be polyethylene or the like. The receptacle 2 in each of the forms of the invention described herein, can be substantially the same and for convenience are shown as being of the same construction and components. While the cross-sectional shape of the container can be of any suitable shape, the illustrated receptacle 2 has a somewhat rectangular shape with rounded corners. The sidewall 4 is tapered to permit nesting of receptacles 2 one within the other for shipping and handling.

The lid structures 3, 3A, 3B, 3C, 3D of each of the embodiments of the invention, are different particularly in the areas of the hinge structure and latch member while they share a generally similar rim construction and mount structure.

Figure 2:
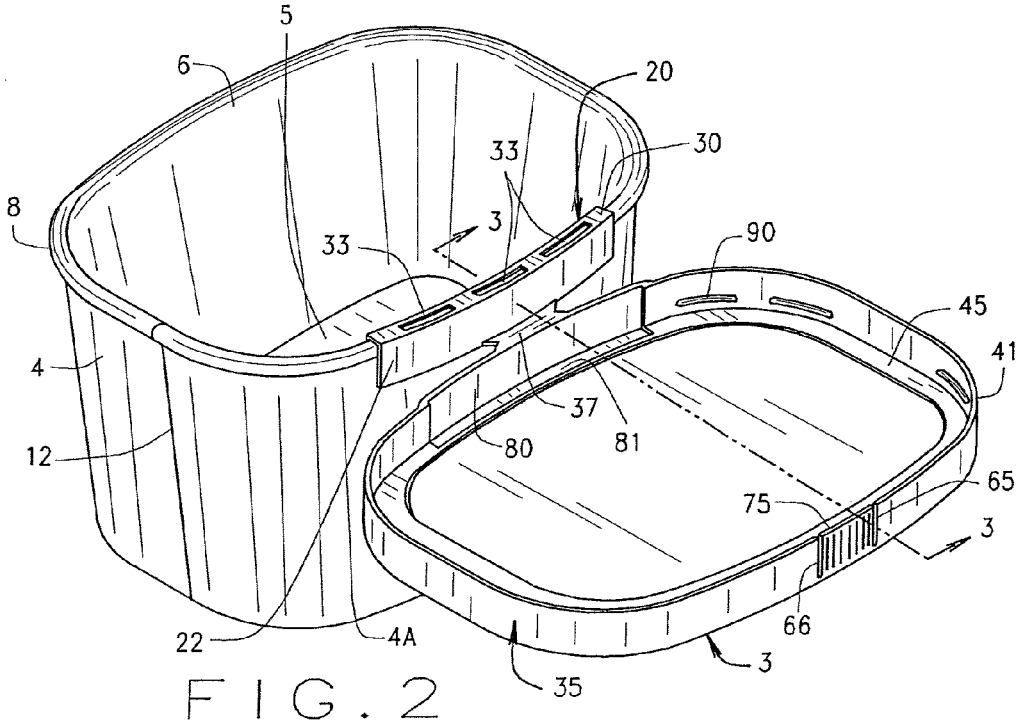
FIG. 2 is a perspective view of the container of FIG. 1 showing a portion of the lid structure in an open configuration.
Figure 3:
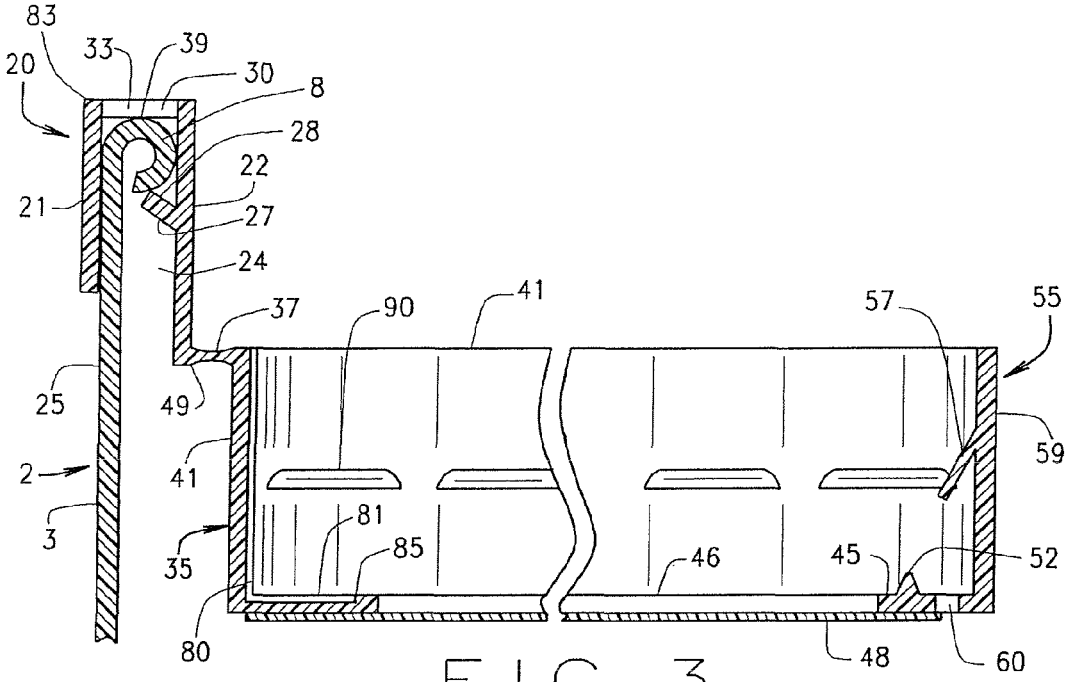
FIG. 3 is an enlarged partial fragmentary view taken along the line 3-3 of FIG. 2.
Figure 4:
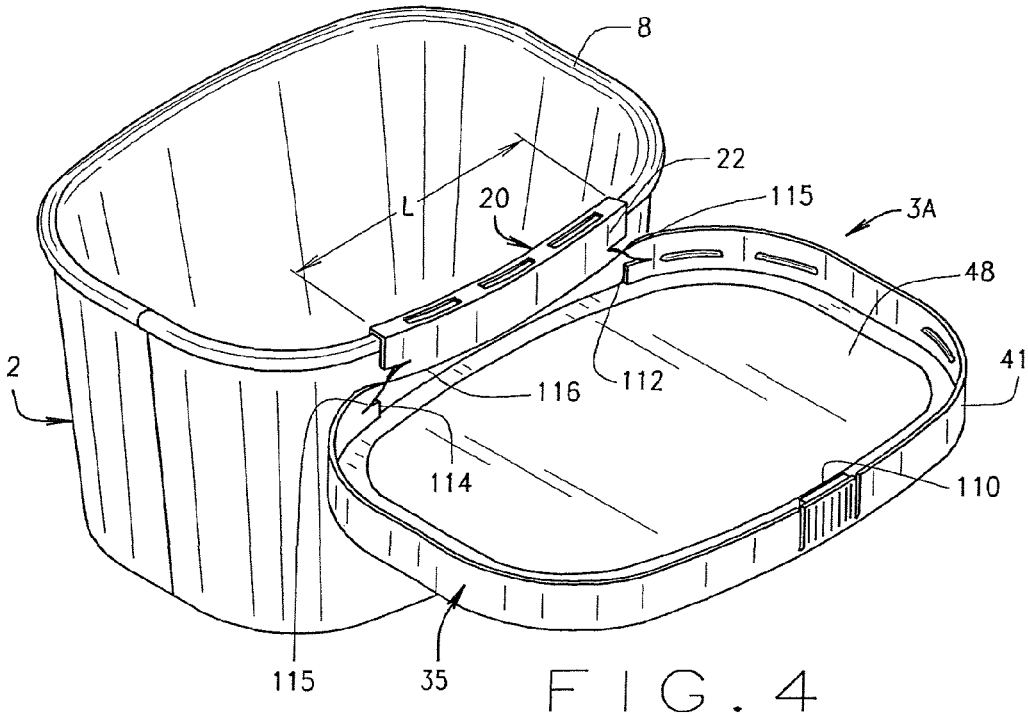
FIG. 4 is a perspective view of an alternative embodiment of the present invention showing the lid structure in an open configuration.

The mount structure 20 is best seen in FIGS. 2, 3 and 4. The mount structure 20 includes a pair of spaced apart wall members 21, 22 forming a channel 24 therebetween. An upper portion of sidewall 4 is received within the channel 24 with the wall 21 engaging an inner surface 25 of the sidewall 4. As shown in FIG. 3, mount structure 20 includes a plurality of upwardly angled undercut flanges 27 projecting into the channel 24 and positioned so that its upper end 28 is positioned for engagement with the lower portion of lip 8. Preferably the undercut lock flanges 27 are formed as an integral part of wall 22 and are flexible enough to permit passing of lip 8 when the channel 24 is placed over the upper end of the side wall 4. In a preferred embodiment, the lock flanges 27 are molded as part of the wall 22. The lock flanges 27 are preferably of a polymeric material, e.g. low density polyethylene, permitting them to flex, thus, allowing the flanges 27 to pass over lip 8. The width of the channel 24 is approximately equal to the width of the lip 8. In a preferred embodiment, the length of mount structure 20 and its component walls 21, 22, is less than the length of one of the longer sides 4A of the rectangular receptacle 2 on which the mount structure 20 is secured. The mount structure 20 includes a bight portion 30 extending between and connecting the wall portions 21, 22. As seen, the bight 30 is provided with a plurality of spaced apart openings 33 each positioned over a respective lock member 27. The openings 33 permit the molding of the mount structure with its lock flange 27 as an integral unit. In the illustrated structure, there are three openings 33 and three lock flanges 27 positioned along the length of the mount structure 20. In the formation of the integral components of the lid structure 3 which, as shown, would include the mount structure 20 and a rim 35, by molding, the mount structure could be in a position relative to the rim 35 basically as shown in FIG. 3. In a preferred embodiment, the mount structure 20 and rim 35 are molded as an integral unit with a living hinge member 37 therebetween and may be molded from a polymeric material such as low density polyethylene or other suitable polymeric materials.

In a second means of mounting the lid structure 3 to the receptacle 2, adhesive may be applied between an upper surface portion 39 (FIG. 3) of the lip 8 for adhesive attachment. Additionally, the sidewall may be coated with a polymeric material permitting heat sealing of the mount structure 20 to the sidewall. The rim 35 includes a peripherally extending skirt 41 which, in the form of lid structure shown in FIGS. 1-3, extends substantially about the entirety of sidewall 4 of receptacle 2. The rim 35 includes a flange 45 (FIG. 2) defining an opening 46. A paperboard cover 48 may be suitably secured to the flange 45 as, for example, by adhesion or heat sealing and encloses opening 46. The use of a paperboard for cover 48 permits the printing of indicia thereon for display of the product, e.g., a brand name, product type, net weight, etc. may be included on the cover 48, albeit the entire lid structure could be made of plastic.

As suggested above, the skirt 41 and flange 45 are formed as an integral unit and are integral with the mount structure 20 being joined at the hinge member 37. The hinge 37 may have a reduced thickness section 49 therein.

As seen, the flange 45 extends around an inside perimeter of the skirt 41. The skirt 41 may be provided with a rib 52 opposite the mount structure 20 to help retain the shape of the upper end of the sidewall 4 when the lid structure 20 is in a closed configuration whereby the rib 52 would engage an interior surface of the sidewall adjacent the lip 8. Rib 52 also helps seal the lid structure 20 to the receptacle 2 when the lid structure 20 is in a closed configuration.

A latch member 55 is provided to releasably secure the lid structure 20 in a closed configuration as seen in FIG. 1. When released, the lid structure is allowed to have its rim 35 move to an open configuration as seen in FIGS. 2 and 3. The latch member 55 includes a lock undercut protrusion or flange 57 which is in the form of an undercut similar to the flange member 27. Preferably the undercut protrusion or flange member 57 is formed as an integral part of the latch member 55 and further includes a tamper evident tab 59 located forwardly of lock flange 57. The flange 45 is provided with an opening 60 similar to the opening 33 to facilitate molding of the latch member 55 as an integral assembly. The latch member 55 extends from the flange 45 and is positioned between opposite end portions 63, 64 of the skirt 41. While the Figures show latch member 55 and end portions 63, 64 of the skirt 41 located proximate the center of the skirt 41, the latch member 55 and end portions 63, 64 may be located anywhere around the periphery of the skirt. For example, the latch member 55 and end portions 63, 64 may be located proximate one of the corners of the skirt 41.

The latch member 55 has opposite side edge portions 65, 66 each positioned adjacent a respective edge portion 63, 64 as best seen in FIGS. 1, 2. A fracture or break zone 71 or 72, is provided between each of the adjacent side edges 63, 65 and 64, 66 as best seen in FIG. 1. Fracture zones 71, 72, in a preferred embodiment, are areas of thin material formed by molding when the skirt 41 and latch member 55 are formed. The fracture zones 71, 72 are operable for directing a fracture when the latch member 55 is partially separated from the skirt 41. When separated, the free edge 75 (FIG. 2) of the latch member 55 can move away from the skirt 41 with the latch member 55 hinging about an area 77 to release the lock flange 57 from engagement with undersurface of lip 8 to permit the skirt 41 to move to an open position as seen in FIGS. 2, 3.

Zone 71, 72 direct a fracture made by a user to effect opening movement of the latch member 55. The skirt 41, in the embodiment shown in FIGS. 1-3, extends around the perimeter of the rim 35. The flange 45 also extends around the interior perimeter of the skirt 41. A recess 80, as best seen in FIGS. 2, 3, is formed for receipt of the mount structure wall 22 therein. The portion 81 of the recess 80 contained within the flange 45, receives the bight wall 30 therein whereby the edge 83 will be positioned adjacent the corner 85. The edge 83 and corner 85 can cooperate to retain the mount structure 20 within the recess 80 when the lid structure 2 is in a closed configuration. This can facilitate assembly of the lid structure 3 to the receptacle 2 since the hinge 37 may bias the lid structure 3 to the configuration seen in FIG. 3 while imparting low resistance to moving the rim 35 to the open configuration from the closed configuration during operation.

The skirt 41 may also be provided with one or more ribs 90 projecting inwardly and spaced from the flange 45. The ribs 90, by engagement with the lip 8 can assist in holding the rim 35 in a closed configuration in addition to the lock member 57. The fracture zones 71, 72 on opposite sides 65, 66 of the latch member 55 provide tamper evidence to a consumer since the container cannot be easily opened without breaking the fracture zones. The lock flange 57 projects far enough under the undersurface of lip 8 to prevent disengagement therebetween without breaking the fracture zones 71, 72.

Figure 5:
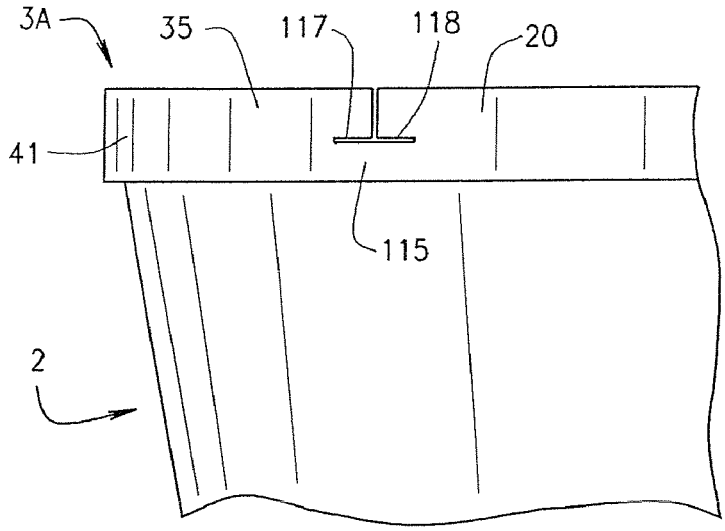
FIG. 5 is a partial elevational view of the container of FIG. 4 showing the lid in a closed configuration.

FIGS. 4, 5 show an alternate embodiment of a lid structure. The alternate embodiment, as illustrated, includes a receptacle 2 and a modified lid structure 3. The lid structure 3A includes a mount structure 20 as described above. The lid structure 3A includes a rim 35 construction the same as described above. Additionally, instead of the rib 52, the lid structure 3 includes a tab 110 which serves basically the same function as the rib 52 but is higher to engage more surface area of the sidewall 4.

The principal difference between the embodiment shown in FIGS. 1-3 and FIGS. 4, 5, is in the hinge area between the mount structure 20 and the rim 35 construction. As seen in FIG. 4, the skirt 41 has opposed ends 112, 114 adjacent the mount structure 20 with a gap 116 between the ends 112, 114 preferably being slightly longer than the length L of the wall 22. Accordingly, when the lid structure 3A is in the closed position, wall 22 will be positioned within gap 116 (the space between the opposed ends 112 and 114) to thereby form a tight seal to the container. In other words, the gap 116 being substantially co-extensive with length L of wall 22 permits the hinged lid structure 3A to be folded effectively flush against the receptacle 2. A pair of hinge members 115 connect the skirt 41 to the wall 22 to permit hinged movement of the rim structure 35 relative to the mount structure 20. The hinges 115 can be integral material formed during simultaneous molding of the mount structure 20 and the rim structure 35. As shown in FIG. 5, slits 117, 118 are formed into the mold to create hinges 115. Slits 117 are formed into the rim structure 35 and slits 118 are formed into the mount structure 20. The hinges 115 work in torsion.

As illustrated in FIG. 5, the hinges 115 are in a natural, untwisted state when the lid structure 3A is in a closed position. As illustrated in FIG. 4, the hinges 115 are in a deformed, twisted state when the lid structure 3A is in an open position. The hinges 115 can be constructed of a thickness, width, length, and material such that they do not overcome the weight of the lid structure 3A when the lid structure 3A is in an open position as shown in FIG. 4. This allows the lid structure 3A to remain in an open position and not spring back into a closed position once it is in an open position. In the form of the invention shown in FIGS. 4, 5, it is preferred that the lid structure 3A be formed of a polymeric material as described above.

Figure 6:
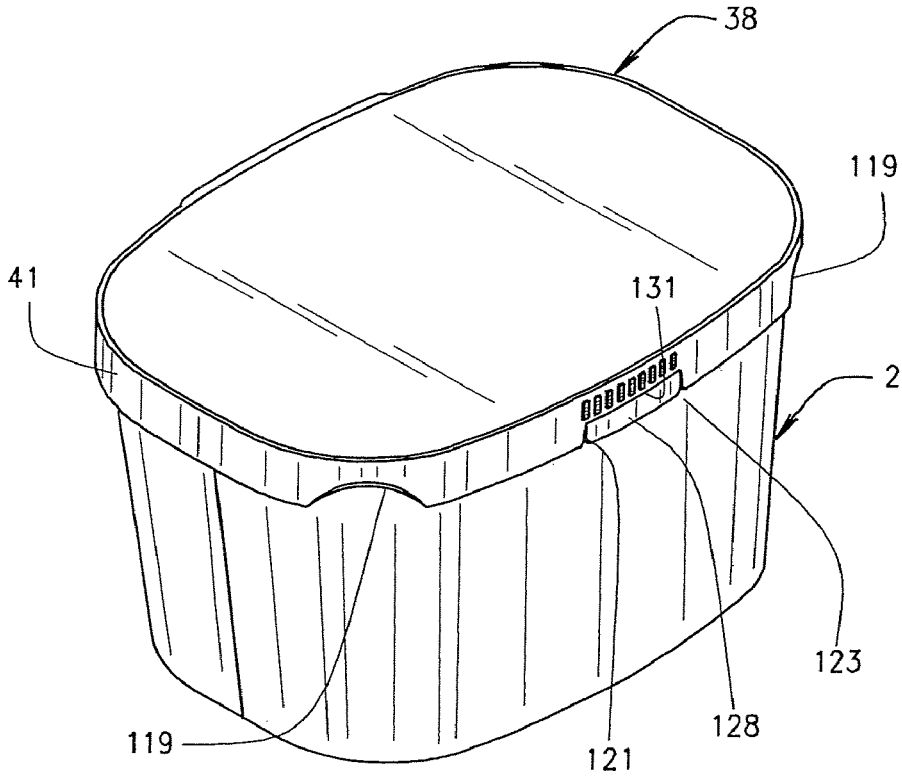
FIG. 6 is a perspective view of a second alternative embodiment of the present invention showing the lid structure in a closed configuration.

FIG. 6 illustrates a second alternative embodiment of the present invention. As in the prior two embodiments, the receptacle 2 is as described above. The mount structure 20 is also as described above. As shown, in this embodiment the lid structure 3B includes a latch member 128 similar to latch member 55 as provided in the prior two embodiments. However, unlike latch member 55, latch member 128 does not extend substantially the entire width of the skirt 41. Instead, latch member 128 has a width substantially less than that of the skirt 41, as shown in FIG. 6, an can hinge relative to the skirt 41 about an area 131.

This embodiment also includes fracture or break zones 121 or 123 adjacent the side edges of latch member 128. Fracture zones 121, 123 direct a fracture made by a user to effect opening movement of the latch member 128. Fracture zones 121, 123, in a preferred embodiment, are areas of thin material formed by molding when the skirt 41 and latch member 128 are formed. The fracture zones 121, 123 are operable for directing a fracture when the latch member 128 is partially separated from the skirt 41. Again, when partially separated, the latch member 128 can hinge about an area 131. Also, as illustrated in FIG. 6, the embodiment has notches 119. Notches 119 are provided to assist a user in disengaging the ribs 90 from the lip 8 when opening the lid structure 3B.

Figure 7:
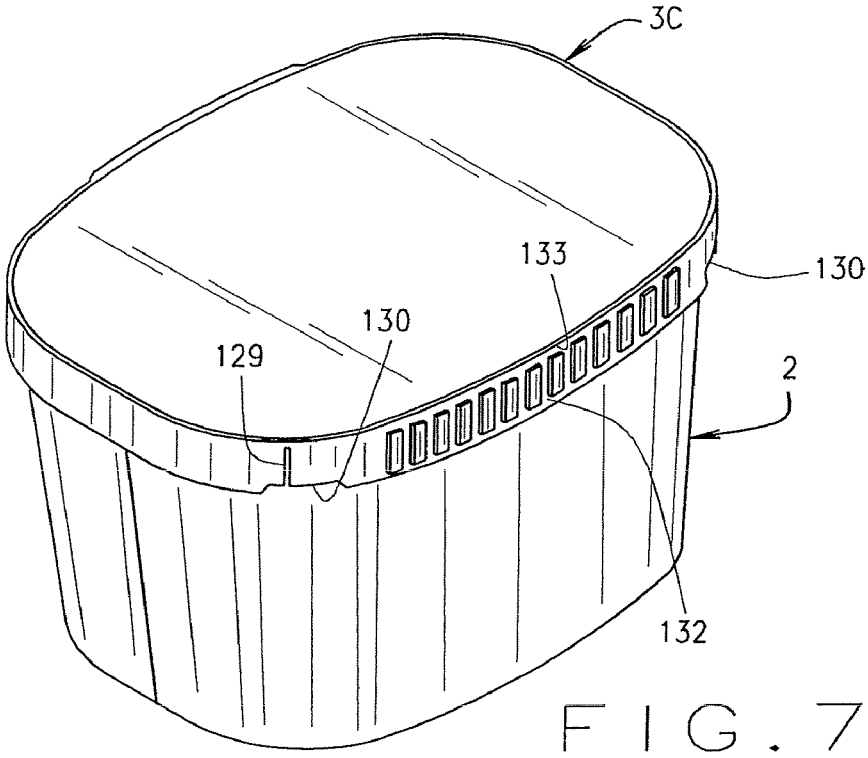
FIG. 7 is a perspective view of a third alternative embodiment of the present invention showing the lid structure in a closed configuration.

FIG. 7 shows a third alternative embodiment of the present invention. As in the prior embodiments, the receptacle 2 is as described above. The mount structure 20 is also as described above. In this embodiment, the lid structure 3C includes a latch member 132. As shown, latch member 132 has a substantially greater length than latch members 55, 128, as described in the previous embodiments. This embodiment includes fracture or break zones 129 adjacent the side edges of latch member 132. Fracture zones 129 direct a fracture made by a user to effect opening movement of the latch member 132. Again, fracture zones 129, in a preferred embodiment, are areas of thin material formed by molding when the skirt 41 and latch member 132 are formed. The fracture zones 129 are operable for directing a fracture when the latch member 132 is partially separated from the skirt 41. When partially separated, the latch member 132 can hinge relative to skirt 41 about an area 133. Also, as illustrated in FIG. 7, the embodiment has notches 130. Notches 130 are provided to assist a user in disengaging the ribs 90 from the lip 8 when opening the lid structure 3C.

Figure 8:
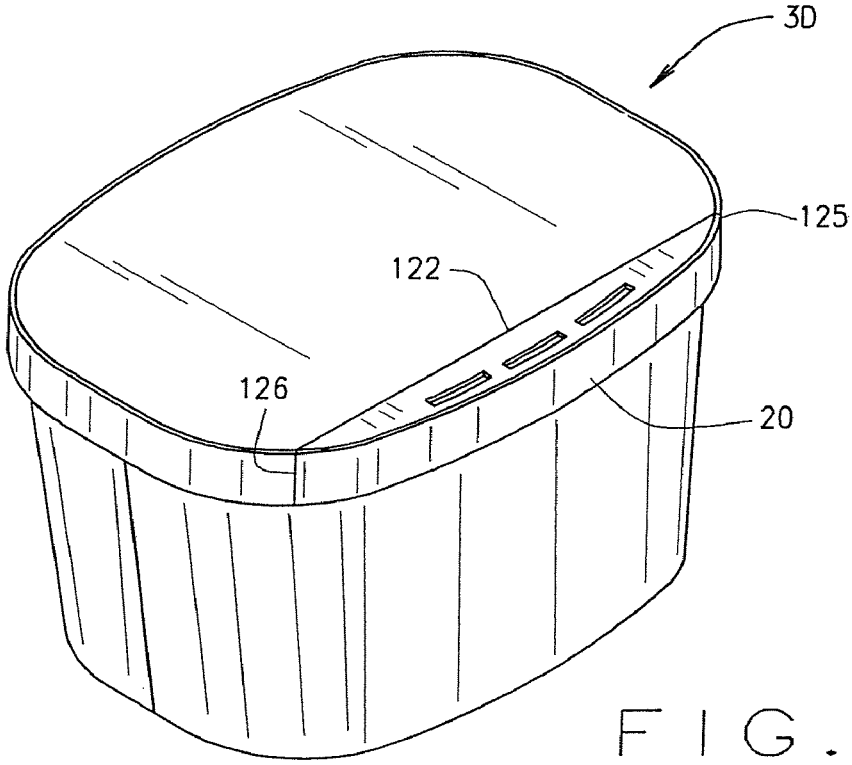
FIG. 8 is a perspective view of a fourth alternative embodiment of the present invention showing the lid structure in a closed configuration.
Figure 9:
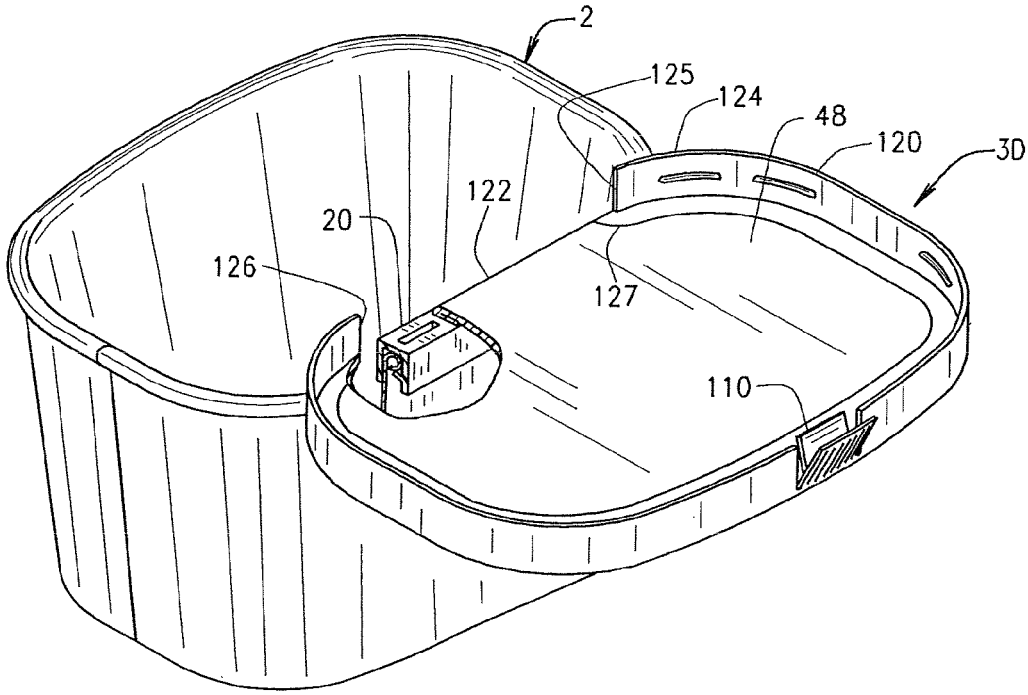
FIG. 9 is a perspective sectional view of the embodiment shown in FIG. 8 showing the lid structure in an open configuration.

FIGS. 8, 9, illustrate a fourth alternative embodiment of the present invention. As in the prior embodiments, the receptacle 2 is as described above. The mount structure 20 is also as described above. The rim 120 is substantially as described above for the rim 41 except for adjacent the mount structure 20. As shown, the cover 48 has a portion 122 thereof functioning as a hinge as does the hinge 37 shown in FIG. 3. As illustrated, the rim 120 has a skirt 124 with a gap between opposed ends 125 and 126 positioned adjacent the mount structure 20. The flange 127 also ends adjacent the hinge area 122 and the mount structure 20. In this embodiment, the cover 48 is scored along line 122 to facilitate the bending of the paperboard cover therealong. In this manner the cover serves as a flange for the lid structure 3D to move between an open (FIG. 9) and a closed (FIG. 8) positions. As best seen in FIG. 9, when the rim 120 moves to a container open position, the cover 48 is reverse bent along line 122. The cover 48 is suitably secured to the mount structure as by adhesion or heat sealing.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

We claim:

1. A hinged lid structure configured to be attached to a container having a free end, a sidewall depending therefrom, and a bottom, said lid structure comprising:

a rim including a flange and a skirt, said flange configured to overlie said container free end and said skirt configured to be positioned outside of and circumscribe at least a portion of said container free end;

a mount structure including a pair of spaced apart wall members forming a channel therebetween configured to receive less than an entire periphery of an upper portion of said container sidewall;

a hinge including two flexible torsion members connecting said rim to said mount structure;

a latch member attached to said rim having a tab and a lock undercut protrusion projecting from said tab configured for engaging an upper portion of a sidewall of said container;

wherein said tab is secured to at least one edge of said skirt at a fracture directing zone; and wherein said torsion members are in a substantially untwisted state when said lid structure is in a closed position and in a twisted state when said lid structure is in an open position.

* * * * *